US011805881B1

(12) United States Patent
Goetzelman

(10) Patent No.: US 11,805,881 B1
(45) Date of Patent: Nov. 7, 2023

(54) WAX WARMER WITH AUTOMATED STIRRING

(71) Applicant: ENSO WAX LLC, Tampa, FL (US)

(72) Inventor: Kirsten Goetzelman, Tampa, FL (US)

( * ) Notice: Subject to any disclaimer, the term of this patent is extended or adjusted under 35 U.S.C. 154(b) by 0 days.

(21) Appl. No.: 18/053,781

(22) Filed: Nov. 9, 2022

(51) Int. Cl.
*A45D 26/00* (2006.01)
*A45D 34/00* (2006.01)

(52) U.S. Cl.
CPC .... *A45D 26/0014* (2013.01); *A45D 2034/002* (2013.01); *A45D 2200/05* (2013.01); *A45D 2200/155* (2013.01)

(58) Field of Classification Search
CPC .. A45D 26/00; A45D 26/14; A45D 2026/008; A45D 34/00; A45D 34/02; A45D 34/04; A45D 2034/002; A45D 2200/05; A45D 2200/058; A45D 2200/15; A45D 2200/152; A45D 2200/155; A45D 2200/20; C11C 5/02; C11C 5/023; B65D 25/00; B65D 25/16; B65D 25/18; A61L 9/00; A61L 9/012; A61L 2209/13; A61L 2209/15; H05B 1/00; H05B 1/02; H05B 1/0252; H05B 1/0297; H05B 3/06; H05B 2203/021
See application file for complete search history.

(56) References Cited

U.S. PATENT DOCUMENTS

| | | | | |
|---|---|---|---|---|
| 2,700,723 | A * | 1/1955 | Lynch, Jr. | A47J 36/32 99/332 |
| 4,721,036 | A * | 1/1988 | Brandt | B01F 29/63 99/348 |
| 6,678,470 | B1 * | 1/2004 | Hoshino | H05B 3/0009 392/311 |
| 7,231,872 | B2 * | 6/2007 | Babicz | A23G 1/0046 99/348 |
| 8,707,862 | B1 * | 4/2014 | Oliver | A47J 36/165 99/348 |
| 2020/0405096 | A1 * | 12/2020 | Pan | A47J 37/108 |
| 2021/0298518 | A1 * | 9/2021 | Giezeman | B01F 29/83 |

* cited by examiner

*Primary Examiner* — Robert A Lynch
(74) *Attorney, Agent, or Firm* — Larson & Larson; Justin P. Miller; Frank Liebenow

(57) ABSTRACT

The wax warmer with automated stirring combines the heating element and wax temperature control with a rotating wax reservoir. The rotating wax reservoir causes the associated stored wax to rotate with respect to the body of the device. To interrupt the flow of the wax within the rotating reservoir, and cause mixing and stirring, a stationary stir stick is placed in the path of rotation. As the moving wax contacts the stationary stir stick, turbulence is caused, resulting in mixing. The mixing helps to maintain a consistent temperature of wax within the reservoir. The stir stick is preferably held in position by a slot within the lid, removal of the lid causing removal of the stir stick, removing the stir stick as an obstacle to the user accessing the wax within the vessel.

17 Claims, 14 Drawing Sheets

WAX WARMER WITH AUTOMATED STIRRING

FIELD

This invention relates to the field of wax warming devices and more particularly to a device to warm wax while mixing.

BACKGROUND

Body waxing has existed for centuries, with evidence of the practice dating back to ancient Egypt. Today, both men and women wax various parts of their bodies for cosmetic and hygienic reasons.

Body waxing requires the application of warm wax to the skin.

What is needed is a device that will melt wax for application while maintaining a consistent wax temperature and consistency.

SUMMARY

Wax warming machines are devices used to melt wax to make it pliable enough for application to the body. After application the wax fuses with the hair, with removal of the wax causing removal of the hair.

A wax warming machine typically includes a heating element to melt the wax, and a control to regulate the wax temperature.

The wax warmer with automated stirring combines the heating element and wax temperature control with a rotating wax reservoir.

The rotating wax reservoir causes the associated stored wax to rotate with respect to the body of the device.

To interrupt the flow of the wax within the rotating reservoir, and cause mixing and stirring, a stationary stir stick is placed in the path of rotation. As the moving wax contacts the stationary stir stick, turbulence is caused, resulting in mixing. The mixing helps to maintain a consistent temperature of wax within the reservoir.

In a first embodiment, a stir stick is held in position by a slot within the lid. Thus, when the lid is removed, the search stick is correspondingly removed, along the user to access the wax.

In a second embodiment, the stir stick is held in position by a lid ring, the lid ring being separate from the lid top. This allows the user to remove the lid top to access the wax, while leaving the stir stick in position to continue causing mixing of the melted wax.

The stir stick is preferably a disposable element. This helps to maintain the hygienic nature of the device by encouraging replacement of the stick between uses.

The inner vessel is optionally formed from, or lined with, copper or copper alloys. Copper has natural properties that allow it to destroy a wide range of microorganisms. Certain copper alloys have been shown to kill more than 99.9% of disease-causing bacteria after two hours of exposure. By lining or forming the inner vessel from copper or copper alloy, bacterial propagation within the wax can be reduced or eliminated.

In the preferred embodiment, an inner vessel rotates within a stationary outer vessel. The heating element is fully or partially wrapped around the stationary outer vessel, heat passing through the stationary outer vessel and into the rotating inner vessel.

A lid holder allows the user to remove the lid that covers the inner vessel, hanging the lid on the rear of the device. This prevents contamination associated with resting the lid on adjacent surfaces.

BRIEF DESCRIPTION OF THE DRAWINGS

The invention can be best understood by those having ordinary skill in the art by reference to the following detailed description when considered in conjunction with the accompanying drawings in which.

DETAILED DESCRIPTION

Figure 1:
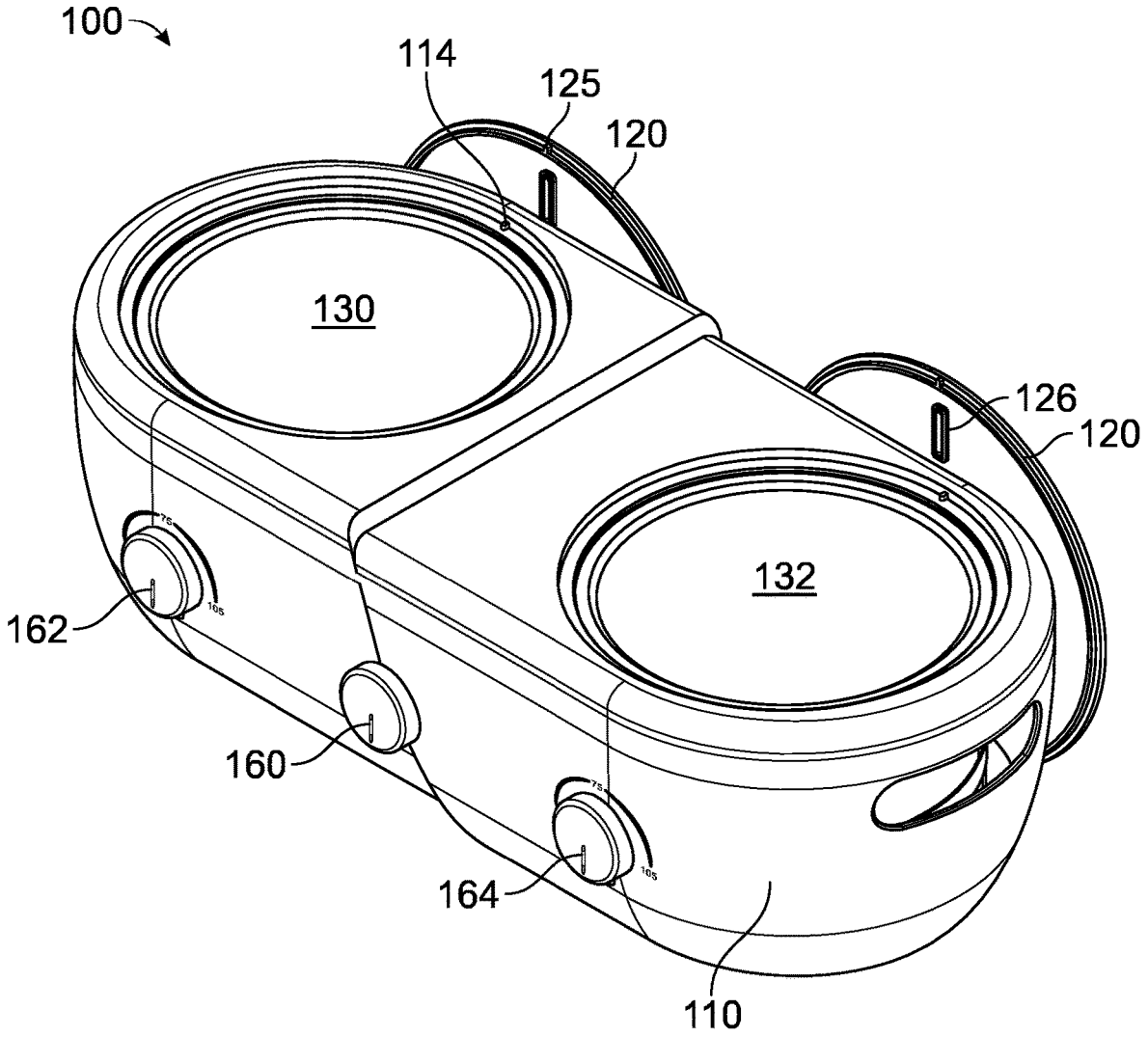
FIG. 1 illustrates a first isometric view, with lids removed, of the wax warmer with automated stirring.

Reference will now be made in detail to the presently preferred embodiments of the invention, examples of which are illustrated in the accompanying drawings. Throughout the following detailed description, the same reference numerals refer to the same elements in all figures.

Referring to FIG. 1, a first isometric view, with lids removed, of the wax warmer with automated stirring is shown.

The wax warmer with automated stirring 100 includes housing 110, through which are visible the first wax pot 130 and the second wax pot 132.

The lids 120 are hanging off the rear of the housing 110. In the first embodiment, each lid 120 includes a stir stick retaining slot 126 that will hold a stir stick 128 (see FIG. 2) that stirs the wax when the lid 120 is on its respective first wax pot 130 or second wax pot 132.

The speed of rotation of the wax pots 130/132 is controlled by the rotation control knob 160.

The first wax pot temperature control knob 162 controls the temperature of the wax in the first wax pot 130. The second wax pot temperature control knob 164 controls the temperature of the wax in the second wax pot 132.

In alternative embodiments of the invention, wax temperature and rotation speed are controlled by a phone application or smart home hub. This allows a user to remotely start or stop rotation, adjust wax temperature, and turn on/off wax heating.

The housing 110 optionally includes an interface that prohibits rotation of the lids 120 with respect to the housing 110. In the preferred embodiment, the interface is an indexing notch 114 and an indexing recess 125. When a lid 120 is placed on top of the housing 110, covering a wax pot 130/132, the lid indexing notch 114 and indexing recess 125 fit together to prohibit lid rotation.

Figure 2:
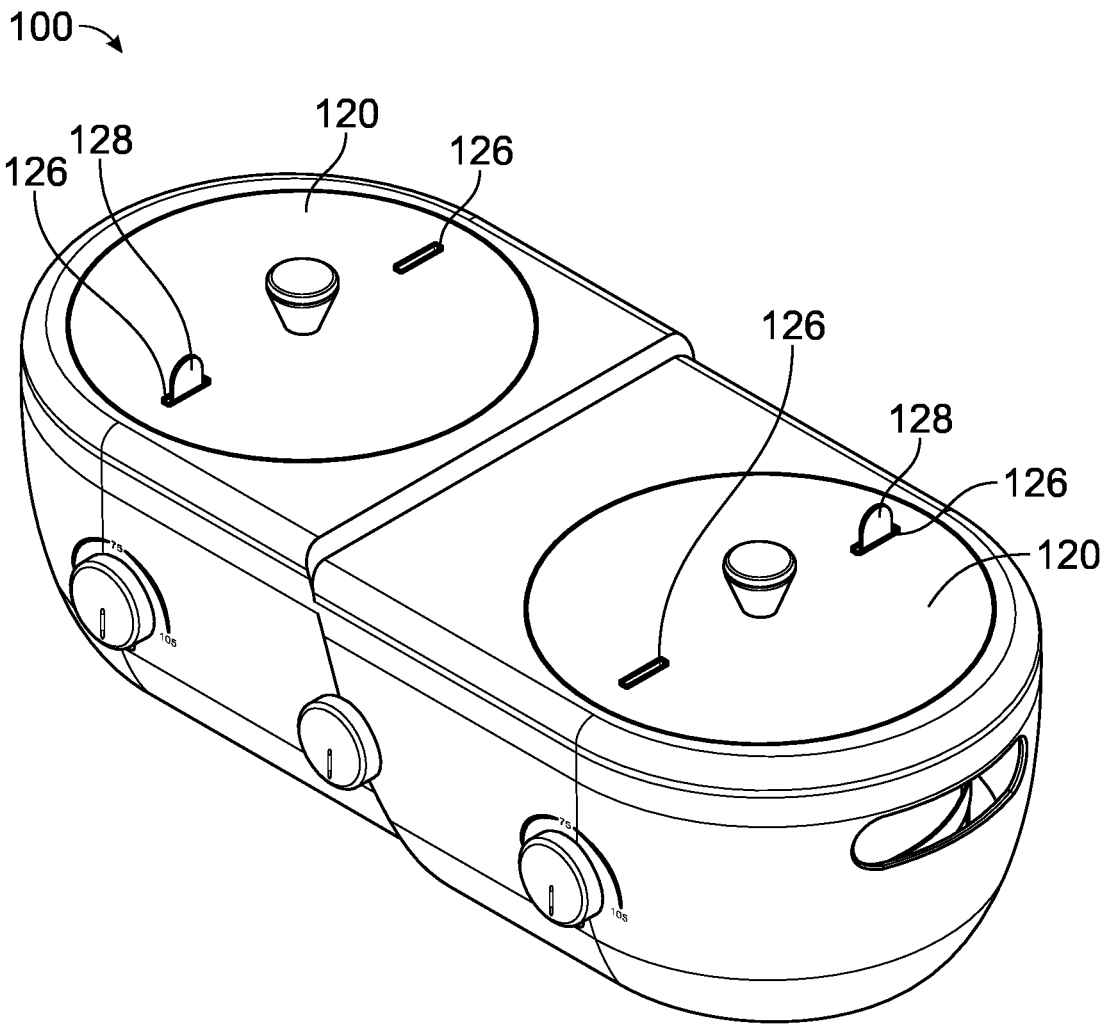
FIG. 2 illustrates a second isometric view, with lids in place, of the wax warmer with automated stirring.

Referring to FIG. 2, a second isometric view, with lids in place, of the wax warmer with automated stirring is shown.

The lids 120 are shown in place, each lid 120 including a pair of stir stick retaining slots 126. A stir stick 128 is optionally inserted into one or both stir stick retaining slots 126, the lid 120 and its associated stir stick 128 remaining stationary while the wax rotates, the stir stick 128 acting to mix the wax.

Figure 3:
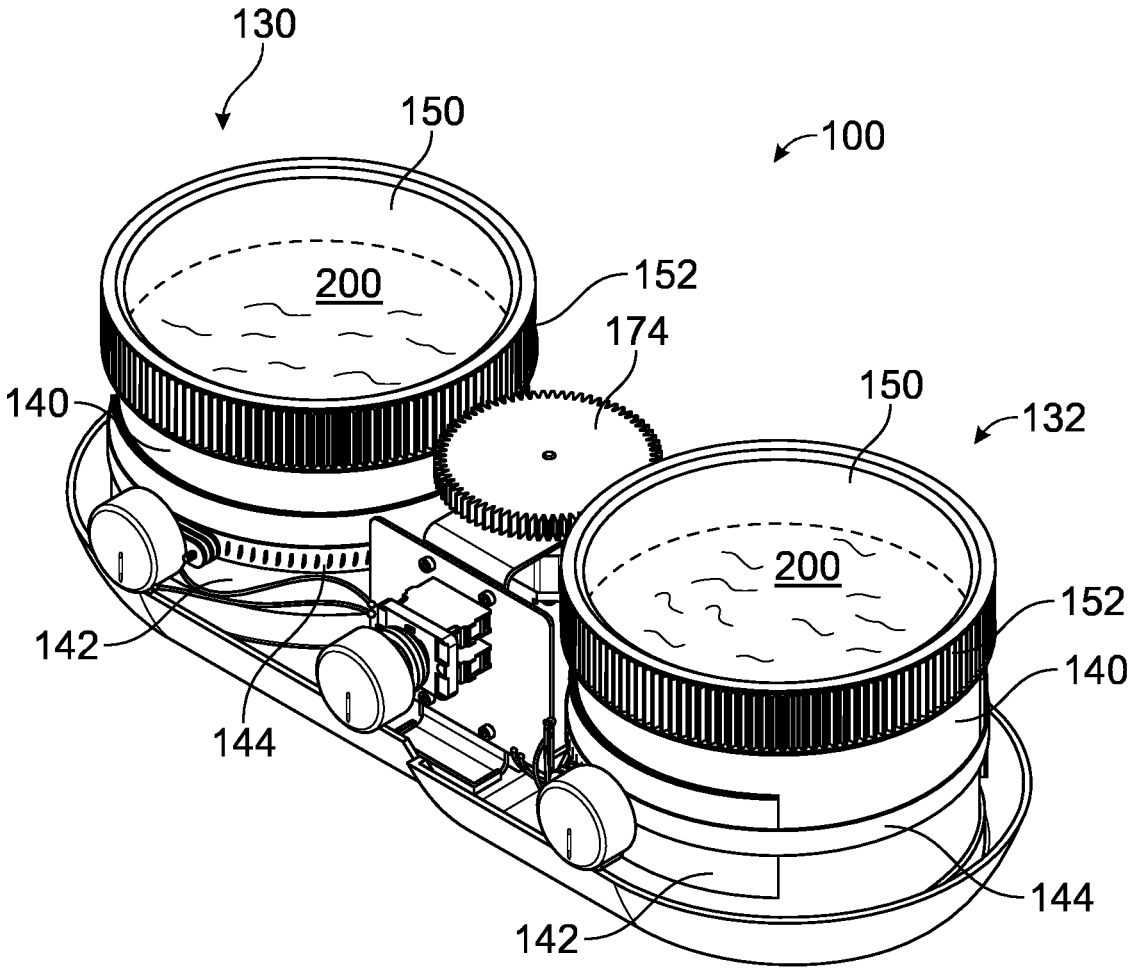
FIG. 3 illustrates a third isometric view, with housing removed, of the wax warmer with automated stirring.

Referring to FIG. 3, a third isometric view, with housing removed, of the wax warmer with automated stirring is shown.

The inner workings of the wax warmer with automated stirring 100 are shown.

The first wax pot 130 and the second wax pot 132 are each formed from an inner vessel 150 and outer vessel 140. The outer vessel 140 includes a heating element, shown as a heating pad 142 held in place by a heating pad clamp 144.

The inner vessel 150 includes an inner vessel peripheral gear 152, which interfaces with a motor gear 174. Rotation of the motor gear 174 causes rotation of the inner vessel 150, rotating the wax 200 held within.

Figure 4:
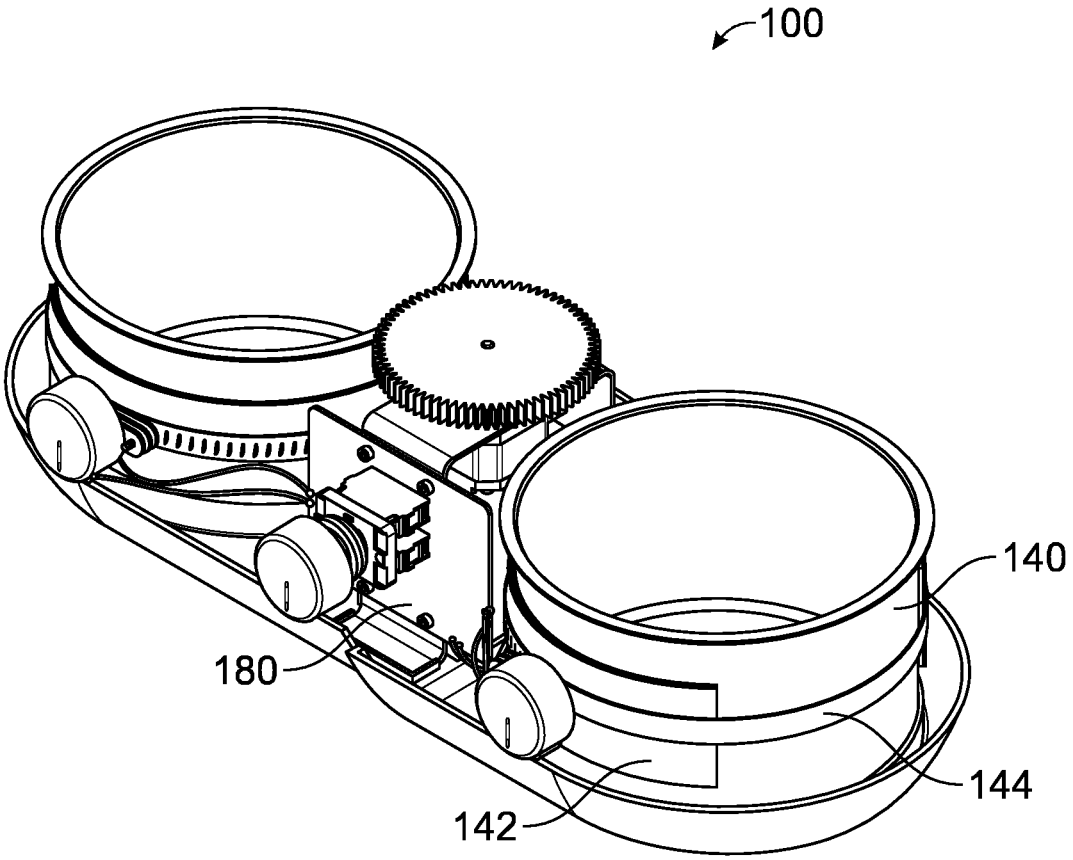
FIG. 4 illustrates a fourth isometric view, with inner vessels removed, of the wax warmer with automated stirring.

Referring to FIG. 4, a fourth isometric view, with inner vessels removed, of the wax warmer with automated stirring is shown.

The outer vessels 140 are visible, with associated heating pads 142 and heating pad clamps 144. The control board 180 modulates the electrical current provided to the heating pad 142 based on temperature information provided by a temperature sensor (not shown).

Figure 5:
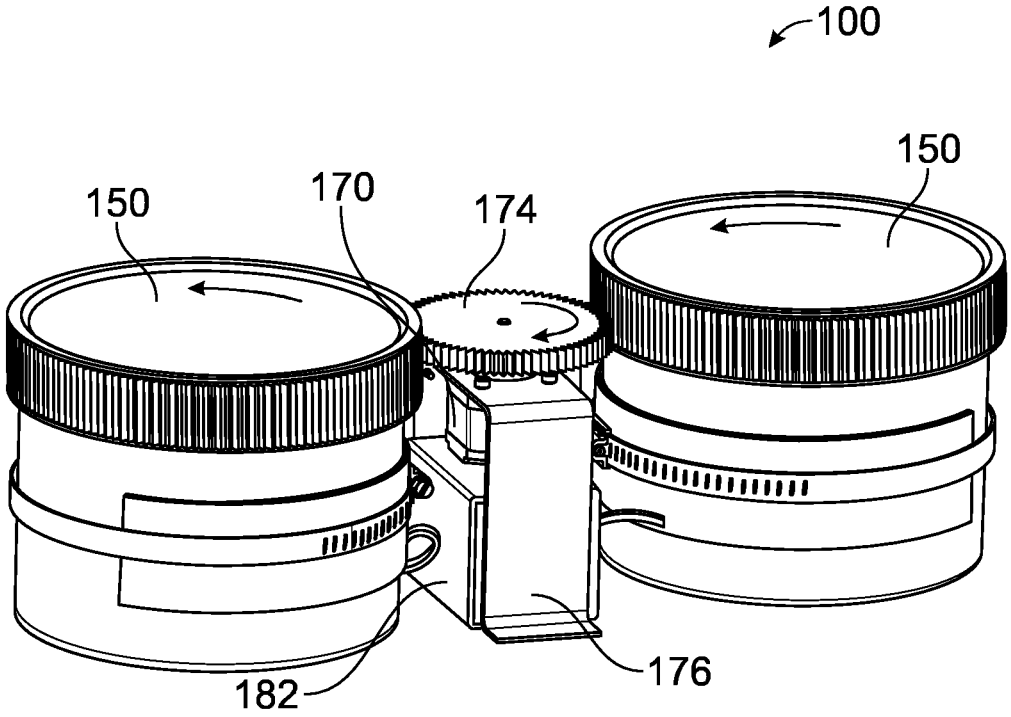
FIG. 5 illustrates a fourth isometric view, with housing removed, of the wax warmer with automated stirring.
Figure 6:
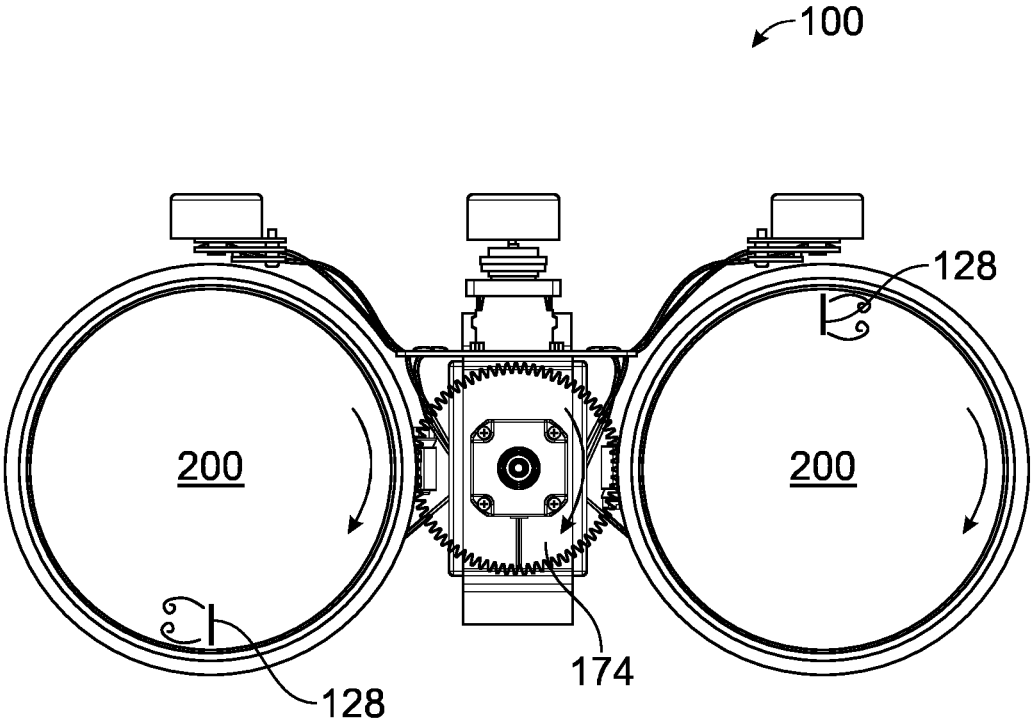
FIG. 6 illustrates a top view, with the housing removed, of the wax warmer with automated stirring.

Referring to FIGS. 5 and 6, a fourth isometric view and a top view of the wax warmer with automated stirring are shown.

In this rearview, rotation caused by the motor 170 results in rotation of the motor gear 174, in turn causing rotation of the inner vessels 150. The motor 170 is stabilized by support bracket 176, which in this embodiment is shown spanning the transformer 182. The transformer 182 converts alternating current to direct current for operation of the wax warmer with automated stirring 100.

Rotation of the inner vessels 150, and resulting rotation of the wax 200, pushes wax against the stir sticks 128, creating turbulence in the wax and associated mixing.

Figure 7:
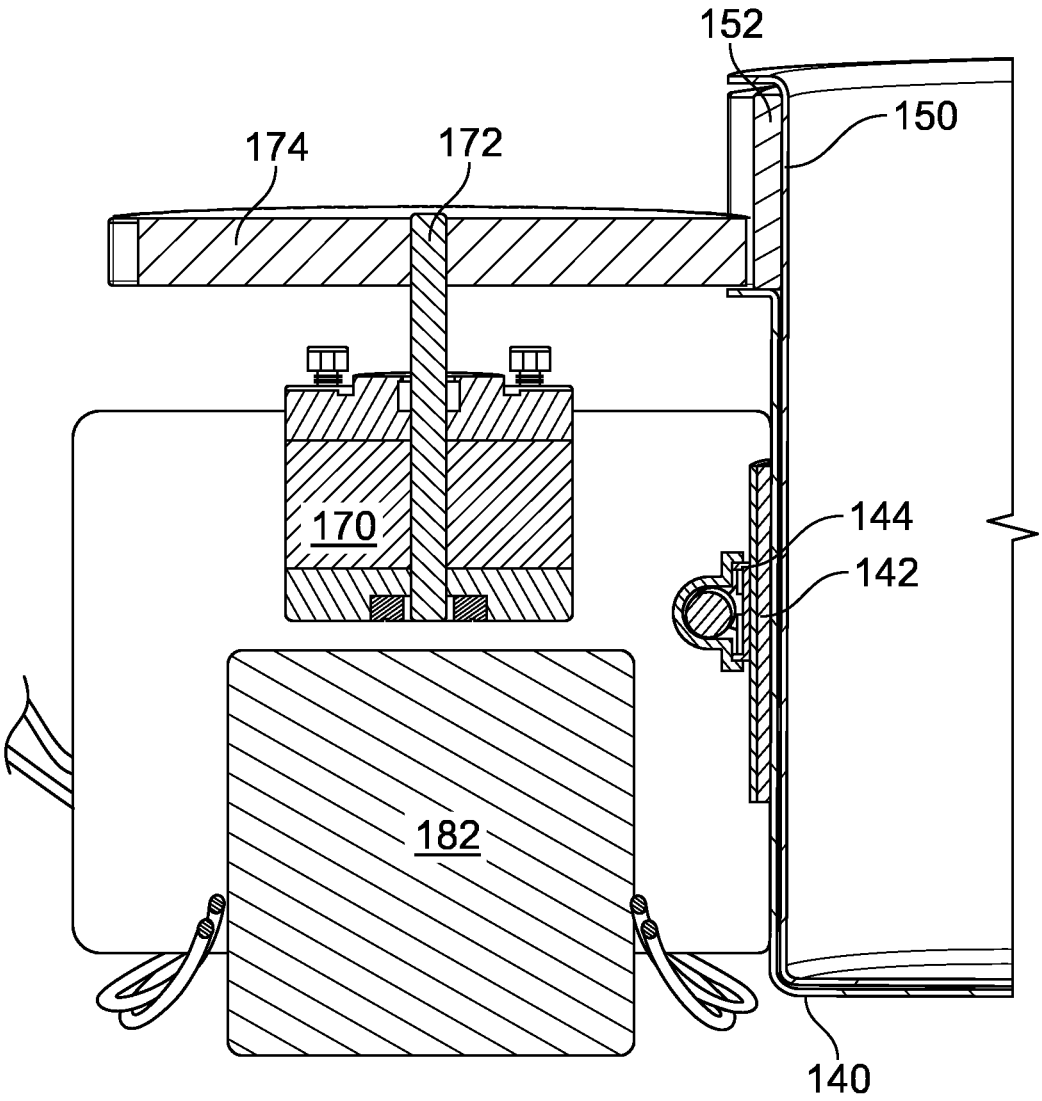
FIG. 7 illustrates a partial cross-sectional view of the wax warmer with automated stirring.

Referring to FIG. 7, a partial cross-sectional view of the wax warmer with automated stirring is shown.

The inner vessel 150 is shown with inner vessel peripheral gear 152, the inner vessel 150 rotating within the outer vessel 140. The motor 170 rotates motor shaft 172, in turn rotating motor gear 174 that interfaces with inner vessel peripheral gear 152.

The outer vessel 140 is shown with heating pad 142 and heating pad clamp 144, The heating pad 142 powered by transformer 182.

Figure 8:
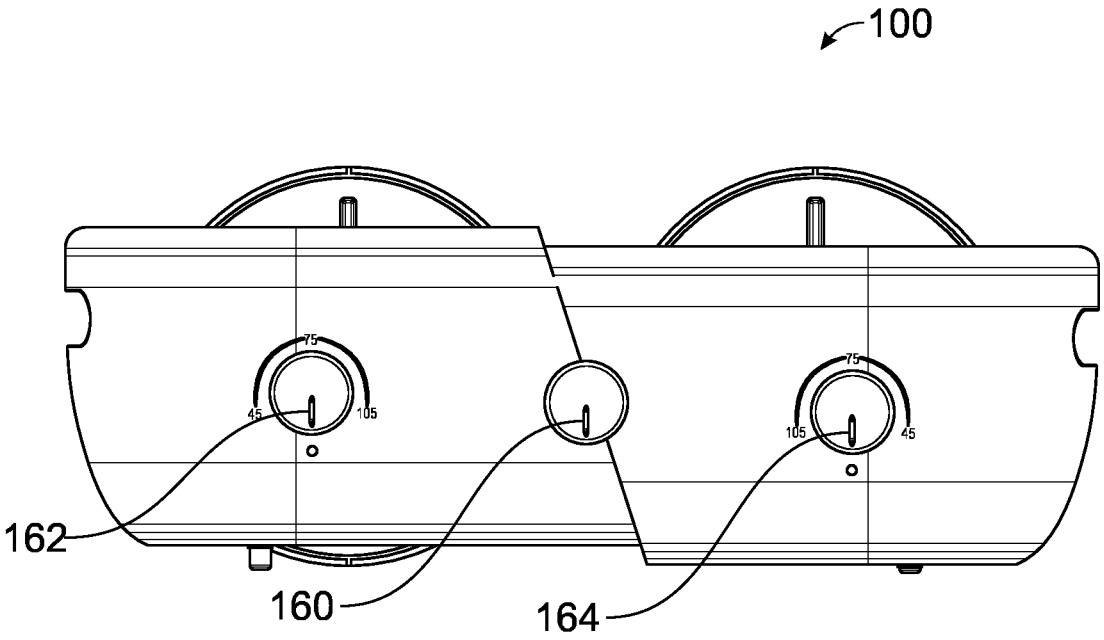
FIG. 8 illustrates a front view of the wax warmer with automated stirring.

Referring to FIG. 8, a front view of the wax warmer with automated stirring is shown.

The device controls are visible, comprised of rotation control knob 160, first wax pot temperature control knob 162, and second wax pot temperature control knob 164.

Figure 9:
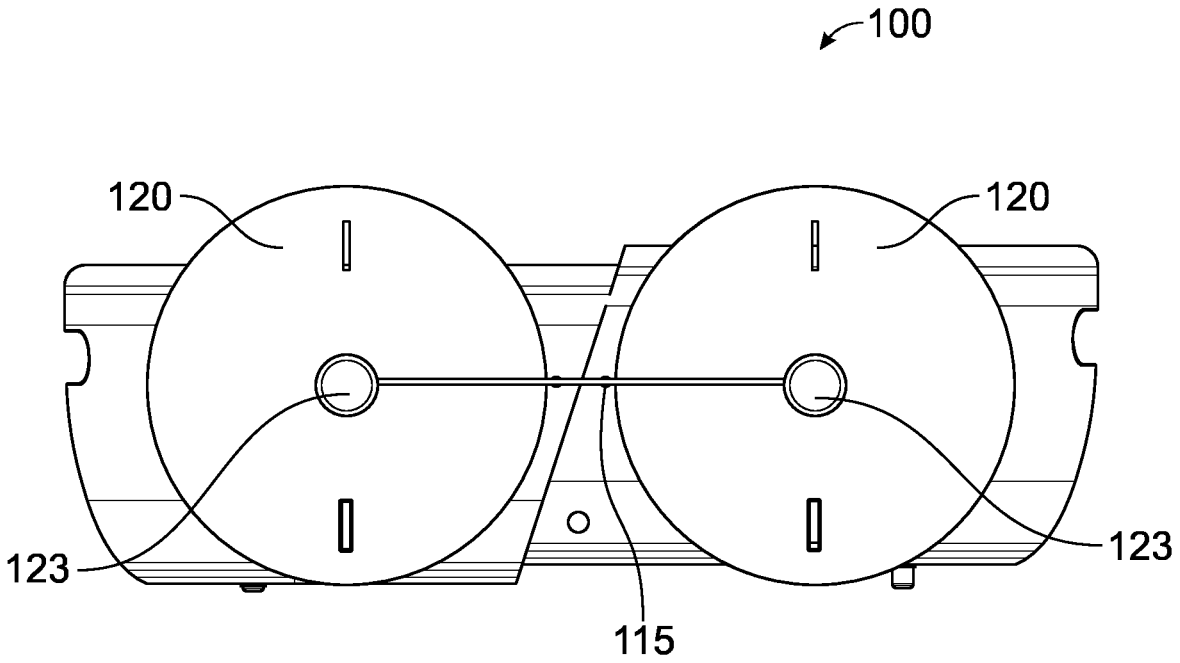
FIG. 9 illustrates a rear view, with lids removed, of the wax warmer with automated stirring.

Referring to FIG. 9, a rear view, with lids removed, of the wax warmer with automated stirring is shown.

Each lid 120 can be placed into the lid retaining bracket 115, the lid retaining bracket gripping the lid 120 by lid knob 123.

Figure 10:
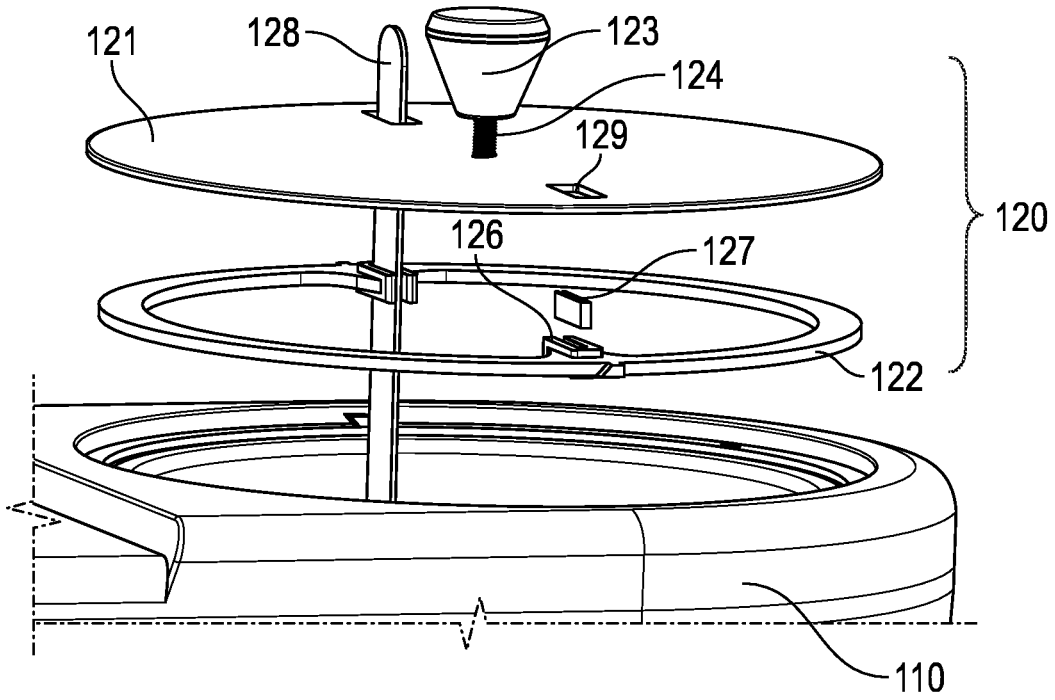
FIG. 10 illustrates a first view of a second embodiment of the lid of the wax warmer with automated stirring.
Figure 11:
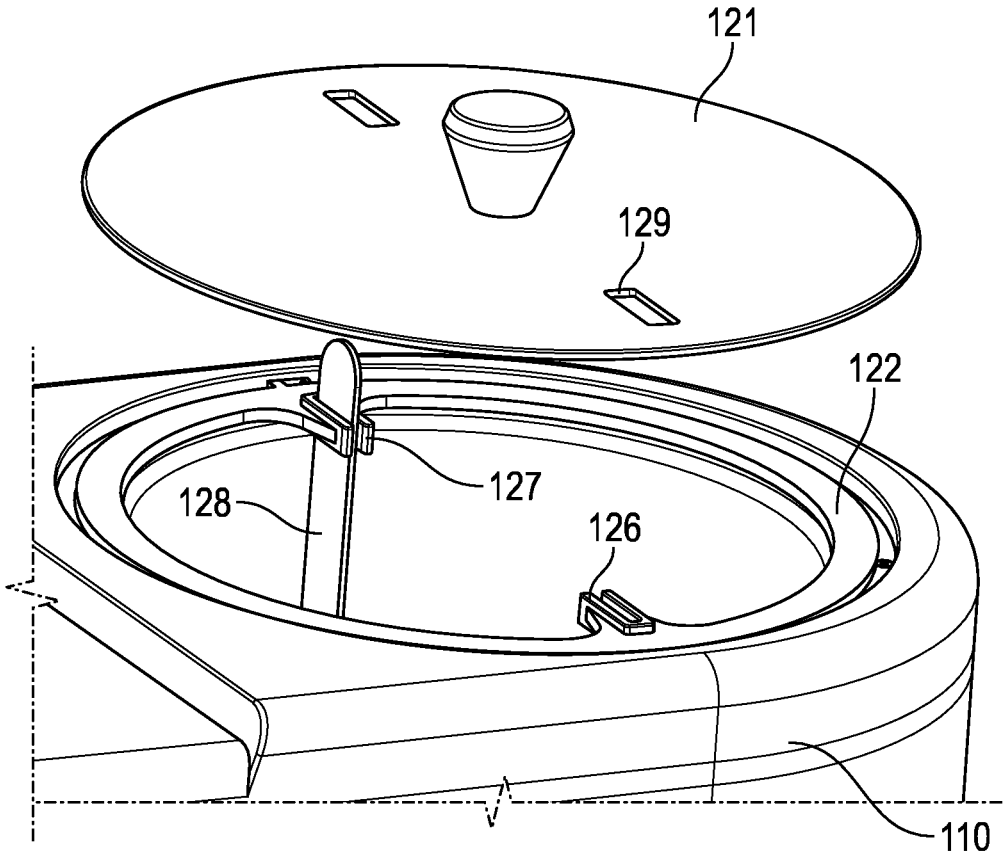
FIG. 11 illustrates a second view of the second embodiment of the lid of the wax warmer with automated stirring.

Referring to FIGS. 10 and 11, a first view and a second view of a second embodiment of the lid of the wax warmer with automated stirring is shown.

In the second embodiment, the lid 120 is divided into a lid top 121 and a lid ring 122. The lid ring 122 holds the stir sticks 128, allowing removal of the lid top 121 via the knob 123 without removal of the stir sticks 128.

During normal operation, the lid ring 122 has one or more stir stick retaining slots 126 lined with optional stir stick retaining slot gaskets 127. A stir stick 128 can be placed into each stick retaining slot 126. The stir stick 128 passes through the lid top 121 at the stir stick passthrough 129.

The knob 123 is held in place with fastener 124.

Figure 12:
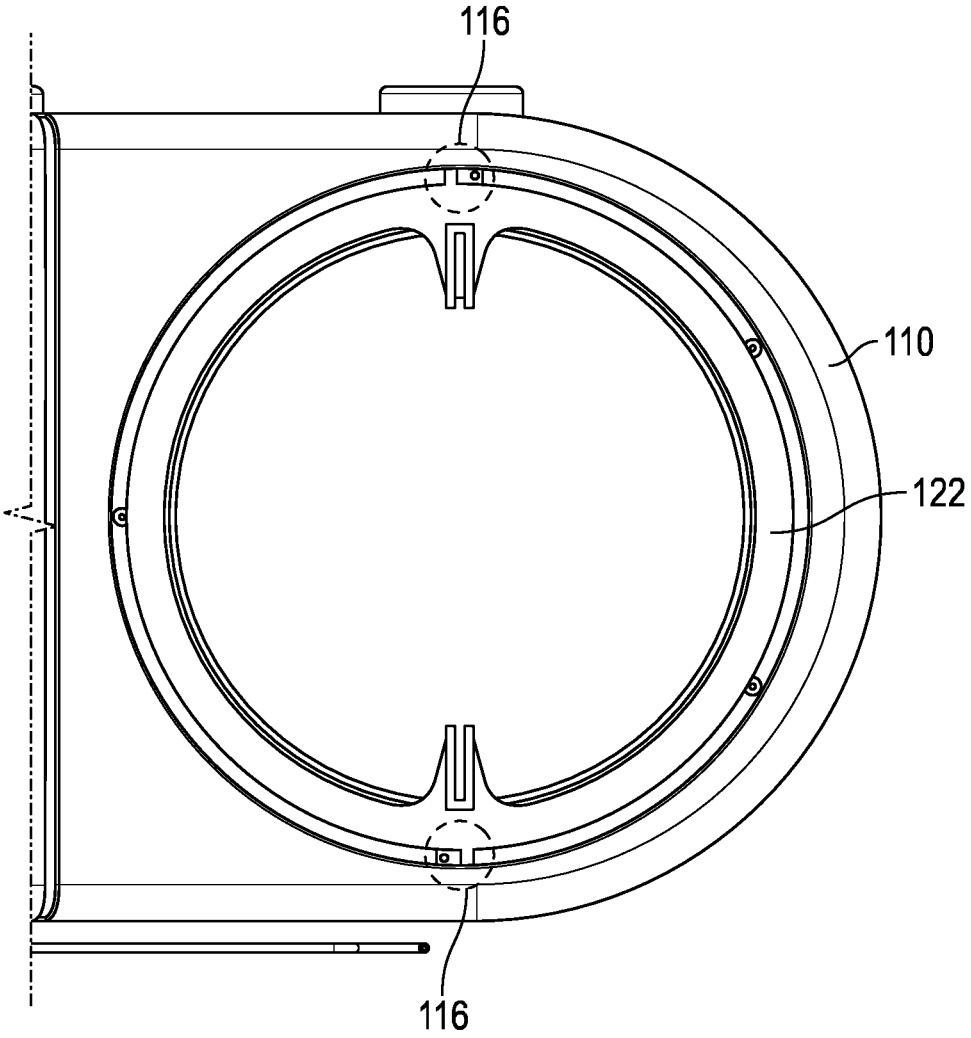
FIG. 12 illustrates a third view of the second embodiment of the lid of the wax warmer with automated stirring.
Figure 13:
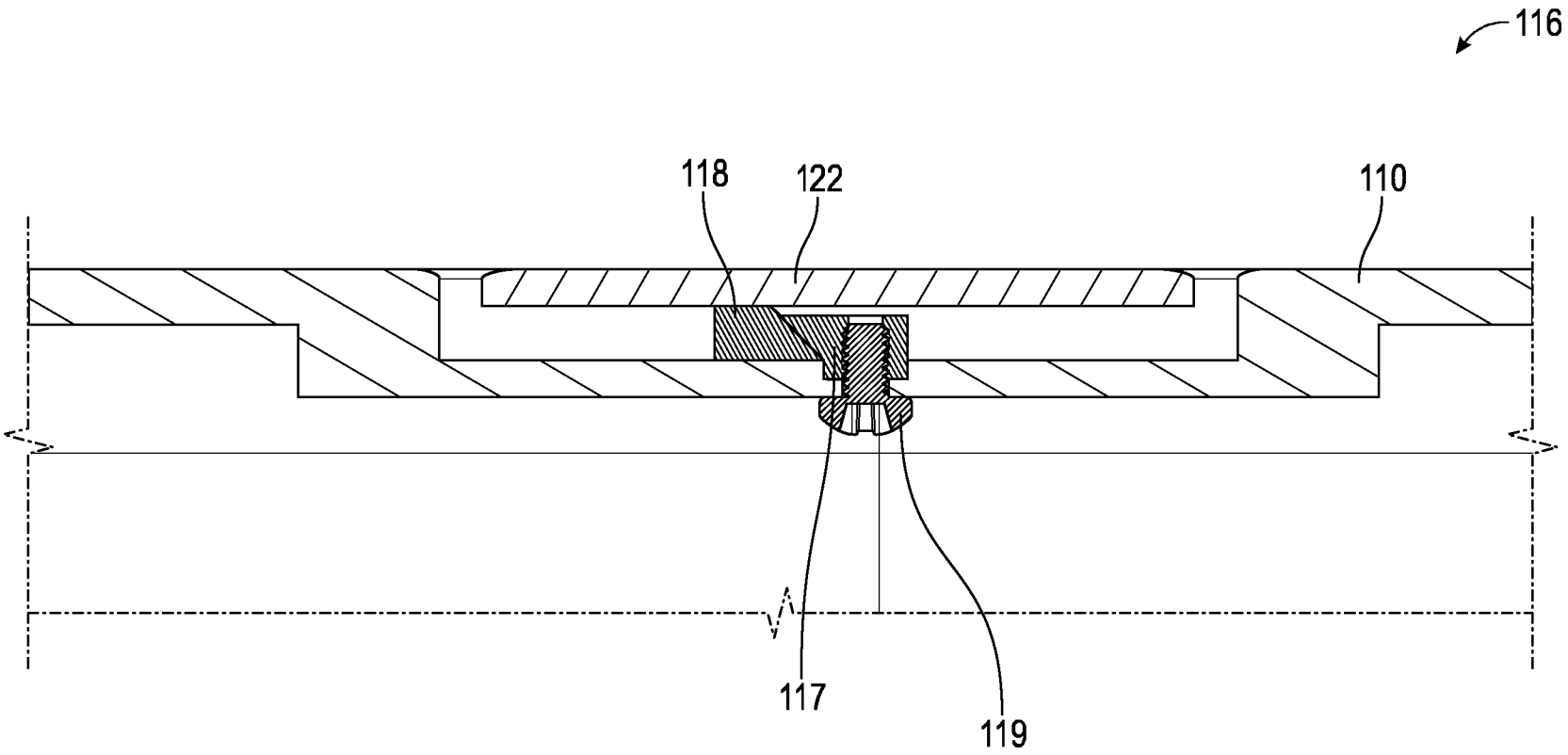
FIG. 13 illustrates a fourth view showing the lid ring locking mechanism in cross-section of the wax warmer with automated stirring.

Referring to FIGS. 12 and 13, a third and fourth view of the second embodiment of the lid of the wax warmer with automated stirring is shown.

A first embodiment of the rotation lock 116 is shown. The rotation lock 116 prevents the lid ring 122 from rotating with respect to the housing 110.

The rotation lock 116 is shown formed from a pair of locking inclined planes, shown as a housing lock ramp 117 and a lid ring ramp 118.

The lid ring ramp 118 is preferably molded as part of the lid ring 122. The housing lock ramp 117 may be molded as part of the housing 110, or held in place with a ramp fastener 119.

Figure 14:
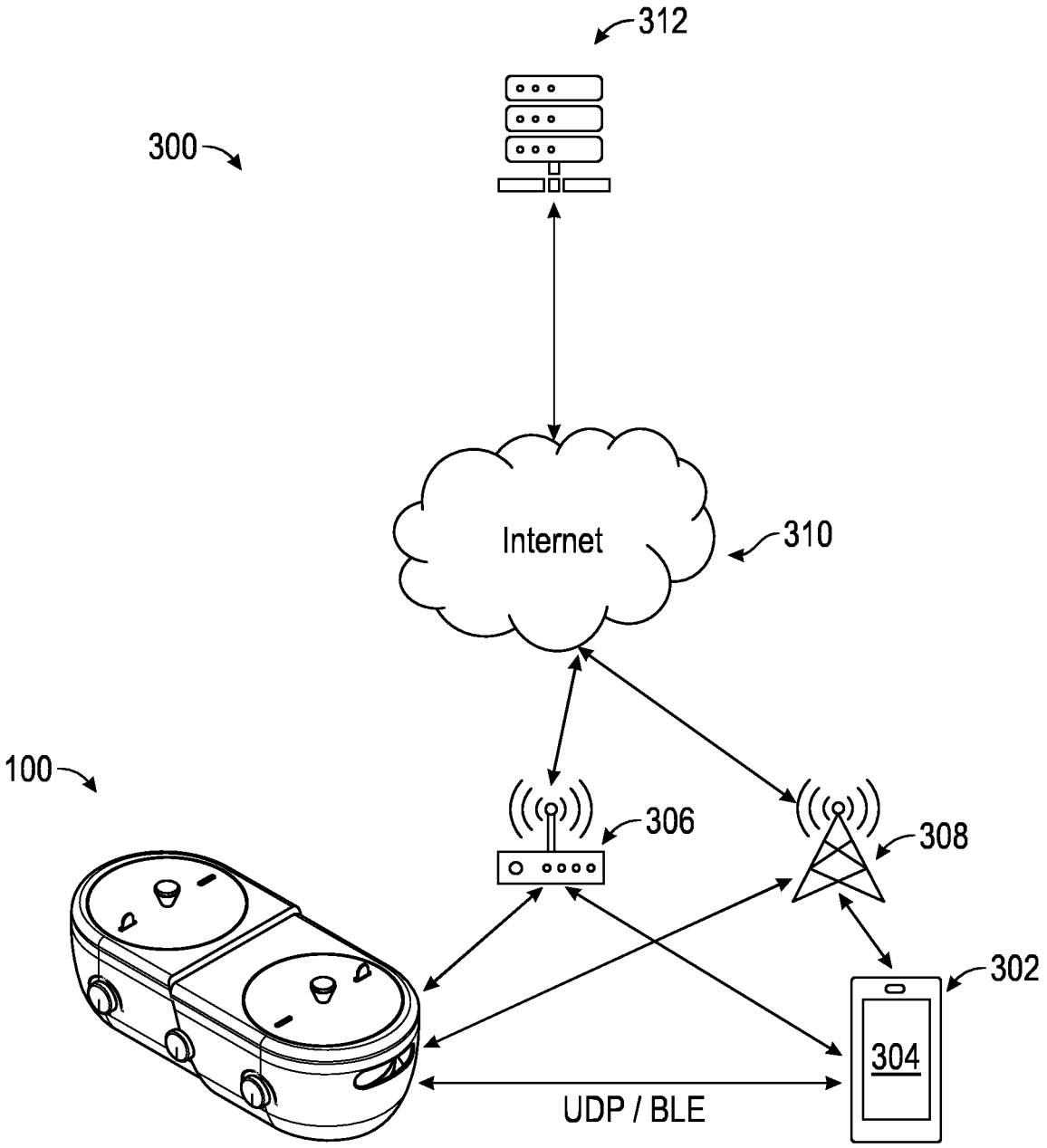
FIG. 14 illustrates an example of how the wax warmer with automated stirring may communicate with, and to be controlled by, a user interface. fourth view showing the lid ring locking mechanism in cross-section of the wax warmer with automated stirring.

Referring to FIG. 14, an example of how the wax warmer with automated stirring may communicate with, and to be controlled by, a user interface is shown.

The communication system 300 is shown with a mobile device 302 having user interface 304. The mobile device 302 may connect with the wax warmer with automated stirring 100 either directly or indirectly.

A direct wireless connection between the mobile device 302 and the wax warmer with automated stirring 100 can be created via User Datagram Protocol (UDP) and/or Bluetooth Low Energy (BLE) protocol. These connection protocols are most useful during initial setup, allowing a user to provide Wi-Fi and other configuration information to the wax warmer with automated stirring 100 via the user interface 304.

Following configuration, the mobile device 302 then communicates indirectly via a router 306 or a cell tower 308. The wax warmer with automated stirring 100 correspondingly communicates via a router 306 or a cell tower 308. It is noted that the mobile device 302 and the wax warmer with automated stirring 100 may share a router 306 or cell tower 308, or use differing routers 306 and cell towers 308.

In a first embodiment, communication then passes from the routers 306 or cell tower 308 to the Internet 310, finally to server 312. Server 312 may be used to track device performance, cache instructions, store device parameters for later review, or to track use of consumables with the goal of notifying a user when additional supplies are required.

In a second embodiment, communication passes from the routers 306 or cell towers 308, through the Internet 310, and the back to routers 306 or cell towers 308. In such a configuration, a server 312 is not required.

In either embodiment, parameters that can be tracked and passed to the server 312 and user interface 304 include: the weight of the wax present within the vessels, which would indicate whether or not a refill is required; the current-draw for the heaters associated with the vessels and the resulting wax temperature; vessel rotation speed; frequency and duration of use; the rate at which the weight within the vessel changes, which would indicate speed of wax consumption; and so forth.

Equivalent elements can be substituted for the ones set forth above such that they perform in substantially the same manner in substantially the same way for achieving substantially the same result.

It is believed that the system and method as described and many of its attendant advantages will be understood by the foregoing description. It is also believed that it will be apparent that various changes may be made in the form, construction, and arrangement of the components thereof without departing from the scope and spirit of the invention or without sacrificing all of its material advantages. The form herein before described being merely exemplary and explanatory embodiment thereof. It is the intention of the following claims to encompass and include such changes.

What is claimed is:

1. A device to maintain a consistent wax temperature within a vessel, the device comprising:
- a housing;
- a rotating vessel;
  - the rotating vessel rotating with respect to the housing;
  - the rotating vessel to be filled with wax;
- a stationary element;
  - the stationary element fixed with respect to the housing;
  - the stationary element protruding into an interior of the rotating vessel;
- a lid:
  - the lid formed from a lid top and a lid ring;
    - the lid top removably covering the rotating vessel;
    - the lid ring interfacing with the housing;
    - the lid ring stationary with respect to the housing during use of the device;
    - the lid ring including a stir stick retaining slot into which the stationary element is placed;
- whereby the lid top can be removed for access to the wax, while leaving the lid ring in place to maintain a position of the stationary element; and
- whereby as the rotating vessel rotates, the wax within the rotating vessel contacts the stationary element, the stationary element causing mixing of the wax within the rotating vessel.

2. The device to maintain a consistent wax temperature within a vessel of claim 1, further comprising:
- an electric motor;
  - the electric motor causing motion of the rotating vessel;
- whereby the electric motor controls a speed and direction of the rotating vessel.

3. The device to maintain a consistent wax temperature within a vessel of claim 1, wherein:
- the stationary element is a removable stir stick;
  - the removable stir stick held in position by a stir stick retaining slot within a lid;
  - the lid prohibited from rotating with respect to the housing;
- whereby the lid supports the removable stir stick which in turn causes mixing of the wax within the rotating vessel.

4. The device to maintain a consistent wax temperature within a vessel of claim 1, further comprising:
- a lid;
  - the lid to cover the rotating vessel;
- a lid support bracket;
  - the lid support bracket affixed to the housing;
  - the lid support bracket providing a location for lid storage when the lid is not covering the rotating vessel.

5. The device to maintain a consistent wax temperature within a vessel of claim 1, wherein:
- the rotating vessel sits within an outer vessel;
  - the outer vessel stationary with respect to the housing;
- a heating element in contact with the outer vessel;
  - heat from the heating element passing through the outer vessel, through the rotating vessel, and into the wax;
- whereby the heat from the heating element causes the wax to melt within the rotating vessel.

6. The device to maintain a consistent wax temperature within a vessel of claim 1, wherein an inner surface of the rotating vessel is formed from copper;
- the copper acting to inhibit microbial growth.

7. A device to maintain consistent temperature and consistency within wax used for hair removal, the device comprising:
- a housing within which is placed one or more wax pots;
  - each wax pot of the one or more wax pots including a rotating vessel;
  - the rotating vessel intended to hold wax for hair removal;
  - the rotating vessel rotating with respect to the housing;
- a stir stick;
  - the stir stick held stationary with respect to the housing;
  - the stir stick protruding into an interior of the rotating vessel;
  - the stir stick disturbing the wax held within the rotating vessel during rotation of the rotating vessel, thereby causing stirring and maintenance of even consistency;
- a lid;
  - the lid formed from a lid top and a lid ring;
    - the lid top removably covering each wax pot of the one or more wax pots;
    - the lid ring interfacing with the housing;
    - the lid ring stationary with respect to the housing during use of the device;
    - the lid ring including a stir stick retaining slot into which the stir stick is placed;
- whereby the lid top can be removed for access to the wax, while leaving the lid ring in place to maintain a position of the stir stick.

8. The device to maintain consistent temperature and consistency within wax used for hair removal of claim 7, further comprising:
- an electric motor;
  - the electric motor causing motion of the rotating vessel;
- whereby control of the electric motor controls a speed and direction of the rotating vessel.

9. The device to maintain consistent temperature and consistency within wax used for hair removal of claim 7, wherein:
- the stir stick is held in position by a stir stick retaining slot within a lid;
  - the lid prohibited from rotating with respect to the housing;
- whereby the lid supports the stir stick which in turn causes mixing of the wax within the rotating vessel.

10. The device to maintain consistent temperature and consistency within wax used for hair removal of claim 7, further comprising:

a lid;

the lid to cover the rotating vessel;

a lid support bracket;

the lid support bracket affixed to the housing;

the lid support bracket providing a location for lid storage when the lid is not covering the rotating vessel.

11. The device to maintain consistent temperature and consistency within wax used for hair removal of claim 7, wherein:

the rotating vessel sits within an outer vessel;

the outer vessel stationary with respect to the housing;

a heating element in contact with the outer vessel;

heat from the heating element passing through the outer vessel, through the rotating vessel, and into the wax;

whereby the heat from the heating element causes the wax to melt within the rotating vessel.

12. The device to maintain consistent temperature and consistency within wax used for hair removal of claim 7, wherein an inner surface of the rotating vessel is formed from copper;

the copper acting to inhibit microbial growth.

13. A wax warming and stirring device comprising:

a wax pot formed from an inner vessel and an outer vessel;

the inner vessel rotating with respect to the outer vessel;

the inner vessel intended to contain wax for hair removal;

a lid;

the lid for placement over a top of the wax pot;

the lid including a stir stick retaining slot;

the stir stick retaining slot to hold a stir stick stationary with respect to the inner vessel;

the stir stick mixing the wax within the inner vessel as the inner vessel rotates;

the lid is formed from a lid top and a lid ring;

the lid top removably covering the wax pot;

the lid ring stationary during use of the device;

whereby the lid top can be removed for access to the wax, while leaving the lid ring in place to maintain a position of the stir stick; and whereby the wax warming and stirring device maintains the wax at a consistent temperature by rotating and stirring the wax in anticipation of application.

14. The wax warming and stirring device of claim 13, further comprising:

an electric motor;

the electric motor causing motion of the inner vessel with respect to the outer vessel;

whereby control of the electric motor controls a speed and direction of the inner vessel.

15. The wax warming and stirring device of claim 13, wherein:

the stir stick held in position by the stir stick retaining slot within the lid;

the lid prohibited from rotating with respect to the outer vessel;

whereby the lid supports the stir stick which in turn causes mixing of the wax within the inner vessel.

16. The wax warming and stirring device of claim 13, further comprising:

a lid support bracket;

the lid support bracket affixed to a housing;

the lid support bracket providing a location for lid storage when the lid is not covering the inner vessel.

17. The wax warming and stirring device of claim 13, wherein:

the inner vessel sits within the outer vessel;

the outer vessel stationary with respect to a housing;

a heating element in contact with the outer vessel;

heat from the heating element passing through the outer vessel, through the inner vessel, and into the wax;

whereby the heat from the heating element causes the wax to melt within the inner vessel.

* * * * *